US005579287A

United States Patent [19]

Boucher et al.

[11] Patent Number: 5,579,287

[45] Date of Patent: Nov. 26, 1996

[54] PROCESS AND TRANSDUCER FOR EMITTING WIDE BAND AND LOW FREQUENCY ACOUSTIC WAVES IN UNLIMITED IMMERSION DEPTHS

[75] Inventors: Didier D. M. Boucher; Yves Le Gall, both of Six Fours, France

[73] Assignee: L'Etat Francais, represente par le Delegue General pour l'Armement, Paris, France

[21] Appl. No.: 452,854

[22] Filed: May 30, 1995

[30] Foreign Application Priority Data

May 27, 1994 [FR] France ..... 94 06439

[51] Int. Cl.[6] ..... H04R 17/00

[52] U.S. Cl. ..... 367/167; 367/172; 367/159

[58] Field of Search ..... 367/167, 172, 367/158, 159, 142

[56] References Cited

U.S. PATENT DOCUMENTS

| | | | |
|---|---|---|---|
| 4,868,799 | 9/1989 | Massa | 367/172 |
| 4,875,199 | 10/1989 | Hutchins | 367/175 |
| 5,291,461 | 3/1994 | Boeglin et al. | 367/163 |
| 5,363,345 | 11/1994 | Boucher et al. | 367/162 |

FOREIGN PATENT DOCUMENTS

| | | |
|---|---|---|
| 0363032 | 4/1990 | European Pat. Off. . |
| 2634292 | 1/1990 | France . |
| 2665998 | 2/1992 | France . |
| 2665814 | 2/1992 | France . |
| 2671928 | 7/1992 | France . |
| 2674927 | 10/1992 | France . |

*Primary Examiner*—J. Woodrow Eldred
*Attorney, Agent, or Firm*—Oliff & Berridge

[57] ABSTRACT

The present invention relates to a process and transducer for emitting wide band and low frequency acoustic waves in unlimited immersion depth.

The invention is applied to tranducers comprising at least one electro-acoustic motor (1) causing any wall 3 of the said waves to vibrate, and a hollow shell 5 enclosing the said motor 1, and delimiting with the said vibrating wall 3 among others, a cavity 7, characterised in that:

at least one opening 5, causing cavity 7 to communicate with ambient medium 4, is made in said shell 5;

in at least part of the volume of the said cavity 7, at least one flexible bladder 7, is installed;

this bladder 8 is filled with a fluid 9 more compressible than fluid 4.

10 Claims, 1 Drawing Sheet

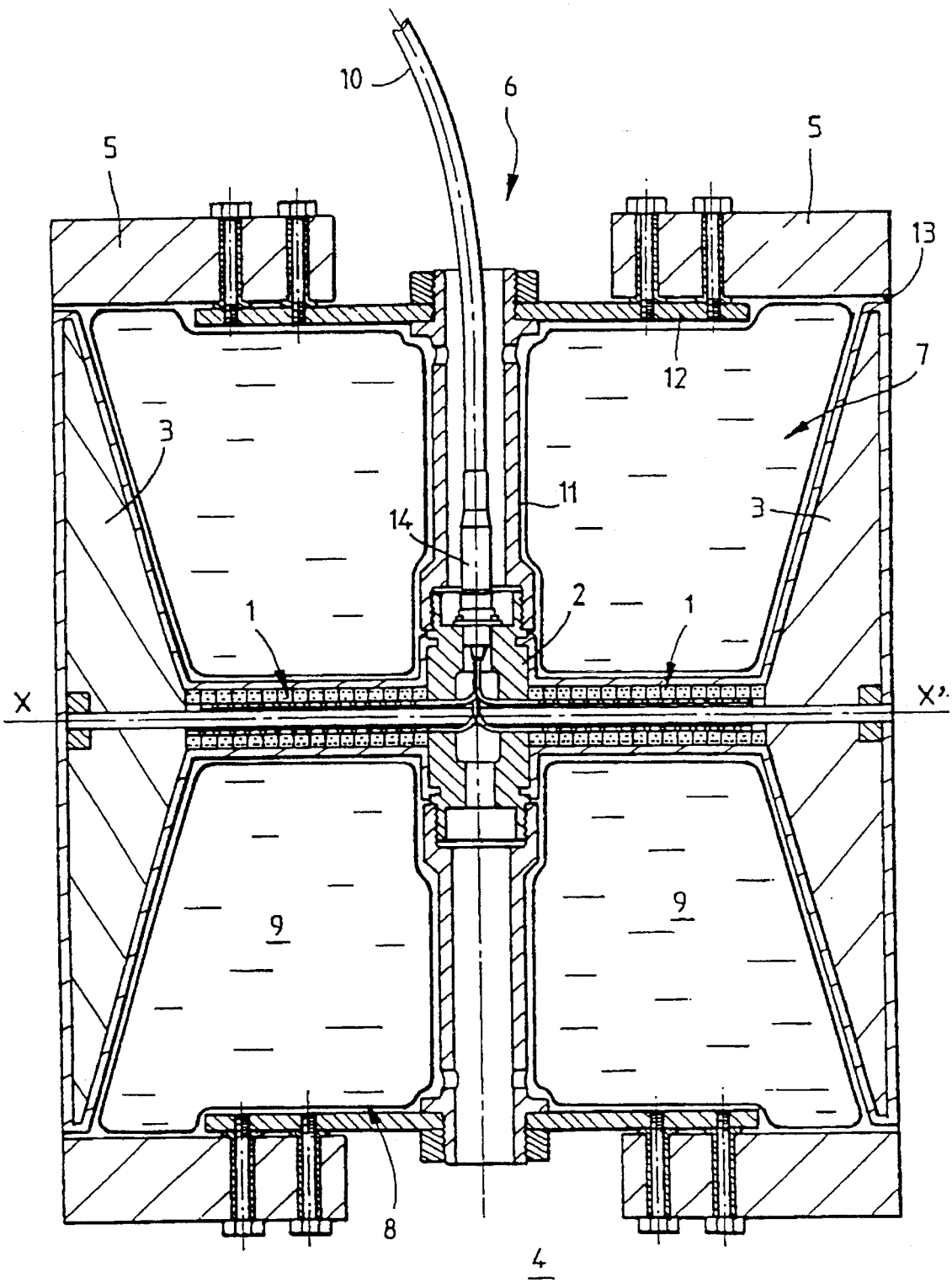
10
6
5
5
13
12
7
3
11
3
14
2
1
1
X
X'
9
9
8
4

PROCESS AND TRANSDUCER FOR EMITTING WIDE BAND AND LOW FREQUENCY ACOUSTIC WAVES IN UNLIMITED IMMERSION DEPTHS

BACKGROUND

The present invention relates to a process and transducer for emitting wide band and low frequency acoustic waves in unlimited immersion depth.

The technical field of the invention is the fabrication of electro-acoustic transducers for the emission of acoustic waves in a fluid.

The main application of the invention is the possibility of emitting low frequency acoustic waves, at great depth and in a wide enough frequency band.

Immergeable electro-acoustic transducers are known, especially piezoelectric ones. The present invention is preferably intended for them although not limited to them. The transducers comprise a rigid hollow cylindrical shell, open at both axial ends, and inside which two identical electro-acoustic motors are arranged coaxial with the latter. The transducers are located on both sides of a central counter-mass and have opposite ends surrounded by a pavilion. The electro-acoustic motors may consist of two stacks of aligned piezo-electric wafers. The external faces of both pavilions are located in the plane of the shell axial ends, so that they are in contact with the fluid in which the shell is plunged, and the external perimeter of these pavilions is as close as possible to the edge of the open axial ends of the shell.

The external faces emit acoustic waves in the fluid when the electro-acoustic motors are electronically energised. These transducers are especially used to emit low frequency acoustic waves in water in a specified direction.

However, one problem formulated by this type of transducer is the propagation of acoustic waves emitted by the pavilion rear faces inside the shell if the latter is also full of fluid and which are then retransmitted into the ambient medium despite the rigidity of the shell, and interfering with the transducer global emission, as indicated in the second solution hereafter described for the transducers immerged at a great depth.

Various solutions have indeed been envisaged and proposed by manufacturers and/or users, such as for example the use of watertight shells filled with gas. However, the shell is required to resist the pressure of immersion in the fluid, and as a result the weight of the transducer is considerably large when the immersion depth is very significant.

Another solution consists in placing masses or static dampers, such as foam, at the pavilion rear part surrounding the end of the electro-acoustic motors, which then absorb the rear radiation and constitute what are called "baffles" with the pavilions. The application of this solution is also limited in deep immersion, since the masses or dampers must be able to resist the pressure, unless this solution is combined with the previous one, i.e., with a rigid shell, which increases the system weight.

In fact, both previous solutions are only extrapolations of the solutions accepted for the wave emission in air.

For normal and very significant immersion depths, four other types of categories of solutions have been developed and various patents have been filed.

A first category of solutions consists of compensating for the external pressure by increasing the internal pressure in different ways in order that a watertight shell does not have to withstand the efforts of resistance to the external pressure:

A particular patent application No. FR 2 634 292 by Mr. Gilles Grosso, relates to a "process and device to maintain the gas contained in an immerged enclosure in pressure balance with the outside", filed on Jul. 15, 1988 is to be noticed. The process consists in associating several bottles, each containing a pre-inflated ductile pocket, at various pressures, to the immersed enclosure such as the shell of a piezo-electric transducer, thus making it possible to compensate the hydrostatic pressure at various immersion depths.

An example of a known patent application FR 2 665 814 of Aug. 10, 1990 filed by THOMSON company relates to "electro-acoustic transducers intended to be immersed", and comprises a system of automatic compensation of the immersion pressure by means of chambers filled with gas and having reduced volumes, in order to compensate only for the axial efforts exercised on the central ceramic pillar of the transducer.

Other patent applications use pneumatic systems to compensate for the external immersion pressure. However, these devices comprise all the mechanical and/or gas supply or storage devices, which are either voluminous and/or complicated. Further, these various devices, avoid the rear wave propagation but do not make it possible to emit on a wide enough frequency range in low frequency, since the wave emission by the pavilions only has a very narrow frequency spectrum, passing through a maximum peak which does not cover a sufficient passing band depending on the type of utilisation.

A second solution consists in avoiding resisting the external pressure, the latter being opposed directly by pressure inside the shell, without a complicated system, as in patent applications FR 2 671 928 and 2 674 927 issued on Jul. 24, 1992 and filed by the French State, General Delegation of Armament, and called "Directive Electro-acoustic transducer". The device comprises a shell with cylindrical walls and bottom separated by slots obturated by a ductile diaphragm, the shell being closed by a flexible diaphragm which delimits a cavity filled with oil. This allows a transmission and pressure balance inside, but also due to the transparency of the flexible diaphragm to acoustic waves, the retransmission of the rear waves in the ambient medium, which creates a resonance peak of high frequencies, with a drop of emission level between the latter and that of the basic frequencies, reducing the power, and therefore the total emission area swept.

A third category of solution makes it possible to solve the mechanical and/or pneumatic problems of the first solution and corresponding frequency narrow band, as well as the problems related to the emission level drops and shift towards the high frequencies of the second solution. This category is described in patent application FR 2 665 998 of May 5, 1988 filed by the French State, General Delegation of Armament. It consists of using a rigid (but not airtight) shell, making it possible to delimit a cavity filled with the ambient fluid at the rear part of the pavilions, wherein closed, airtight elastic tubes filled with gas are placed such that the Helmholtz resonance frequency is close to the fundamental frequency of the axial vibrations of the vibrating assembly. A wide good range of emission frequencies is obtained thanks to 2 peaks corresponding to the own frequencies, one being linked to the transducer mechanical vibrations, and the other to the cavity, and with a maximum attenuation of 5 dB between two peaks.

Furthermore, the problem has been reported with the resistance to immersion pressure of the external shell of the elastic tubes, where their smaller diameters make it possible to obtain a less heavy assembly. But for great depths, it is compulsory to increase the tube resistance, thus limiting their elasticity and thus it is impossible to obtain very low frequency emitters, and the transducer assembly is loaded.

Finally, a fourth category of solutions make it possible to avoid limiting the depth while keeping a wide and low enough frequency band without complications in their execution. This category is developed with a shell made of a material resisting the elastic pressure, and comprising an opening, whose dimensions are determined in order that by coupling the shell elasticity to the mass of fluid located in this opening, the Helmholtz frequency of the shell cavity is close to the fundamental frequency of the vibrations of the transducer assembly. This category of solution is mainly developed for transducers such as those described in the introduction of the present description, comprising a cylindrical, rigid, hollow shell, open at both axial extremities, and inside which two identical electro-acoustic motors are installed coaxial to the latter, on both sides of a central countermass, and whose opposite extremities are surrounded by a pavilion.

However, if such a solution allows a good shift of the emission range towards the low frequencies compared to the second category of previous solutions, while keeping a wide enough range of frequencies between the obtained two peaks of emission resonance, an attenuation of more than 10 dB between both of them is noticed, and this is penalising to cover the desired ranges of emission with a sufficient power level throughout this range width.

The problem therefore consists in being able to carry out low frequency acoustic transducers in a fluid, without any depth limitation, without loading or increasing the volume and/or the complexity of these transducers, and with a wide enough band width of emission frequencies, without significant drop of level attenuation all along this band width.

SUMMARY OF THE INVENTION

A solution to the formulated problem is a process for emitting low frequency acoustic waves in a fluid by means of a transducer comprising at least one electro-acoustic motor causing any emitting wall of the said waves to vibrate and a hollow shell containing the motor and delimiting a cavity with the vibrating wall among others, wherein:

- an opening is made in the shell causing the cavity to communicate with the ambient medium;
- at least one flexible bladder is installed in all or part of the volume of the cavity;
- this bladder is filled with a fluid more compressible than the fluid.

According to another embodiment with a transducer of the same type as previously, at least one bladder is filled with a fluid more compressible than the ambient fluid and at least one opening is made in the shell making possible the passage of the filled bladder. The bladder is inserted in the cavity through the opening in order that the assembly or at least part of the volume of the cavity is occupied by at least the bladder.

Another solution to the formulated problem is a transducer for emitting low frequency acoustic waves in a fluid as defined above, comprising at least one electro-acoustic motor causing any emitting wall of the waves to vibrate, and a hollow shell containing the motor and delimiting a cavity with the vibrating wall, the transducer comprising at least one opening causing the cavity to communicate with the ambient medium, at least a flexible bladder occupying all or at least part of all the volume of the cavity, the bladder being filled with a fluid more compressible than the ambient fluid.

In a preferred embodiment, to reach the maximum effect from the above solution, the fluid compressibility is lower than $10^9$ N/m$^2$, and the maximum fluid viscosity is equal to that of water, which value is $10^{-6}$ m$^2$/second; preferably, the fluid viscosity is lower than $6.5\times10^{-7}$ m$^2$/second.

A fluid meeting the above characteristics is preferably chosen, as being a totally fluored organic compound, of the C8F18 type, obtained by reaction of C8H18 +18 HF. Its volume mass is:

1,725 kg/m$^3$, and the sound propagation speed C in such a fluid is 570 meter/second, which corresponds to a compressibility defined by the product:

x $C^2=0.56\times10^9$ N/m$^2$, that is to say 4 times less than water, whose module of compressibility is equal to $2.22\times10^9$ N/m$^2$.

Silicone fluid may also be used, whose volume mass is higher than 920 kg/m$^3$, and the sound propagation speed in this fluid is higher than 1010 m/second, corresponding to a module of compressibility higher than $0.954\times10^9$ N/m$^2$.

This results in new processes and transducers for emitting wide band, low frequency acoustic waves in unlimited immersion depth and overcomes the disadvantages mentioned in the current devices.

Indeed, such a process and transducer according to the invention, make it possible to cumulate the advantages previously mentioned in the third and fourth categories of solutions analysed in the introduction. That is to say, the solution with a cavity filled with ambient fluid, wherein closed elastic tubes are installed, make it possible to obtain two peaks of resonance determining a wide enough frequency band range, and without loss nor attenuation of more than 5 dB between both peaks; and the solution with an opening having determined dimensions for the Helmholtz frequency of the cavity to be close to the fundamental one of the vibrations of the mechanical assembly, and it is then possible to decrease the frequency while resisting unlimited pressures.

The characteristics of the present invention are applicable to any type of transducers having a cavity in communication with the ambient medium, such as the ones previously described and taken as examples in the thereafter figure, or in flextensional type transducers (e.g. GB-8823245 patent of J. R. Oswin which adds a Helmholtz resonator in the cavity filled with water of a standard flextensional transducer; compliant tubes may be inserted to increase the compliance and then decrease the frequency).

The interest of the present invention is maximum every time the reduction of the loss of efficiency and frequency attenuation between two peaks of resonance is desired, one peak being linked to the mechanical resonance of the assembly, and the other one to that of a cavity.

The compressible fluid which is located in the latter, in the present invention, has not the same function as the ones used in the current prior art, which is indeed either a fluid of transmission and compensation of the external pressure only, or a cooling fluid, and whose choice, arrangement and criteria had not been determined to date to solve the problem formulated in the present invention.

An interesting application of the transducers according to the present invention is the possibility of being used within the framework of ocean acoustic tomography, for which transducers may be immersed in depths down to 2,000 meters and where the emission in wide enough frequency bands must be possible, at the lowest possible frequencies, to reach the most remote wave propagation. A paper published in the magazine "For Science" No. 158 of December 1990, page 66 and following, by Mrs. Robed SPINDEL and Peter Worcester shows the interest of such an acoustic tomography of the oceans, making it possible to generate three-dimensional images of the area crossed by the waves, and whose behaviour analysis, which is perfectly described and interpretable with precision by the physical laws, enables us to get the information required to determine some properties of the ocean masses, such as their temperature and current.

Other advantages of the present invention could be mentioned, especially within the framework of the previous application to acoustic tomography, but the above mentioned ones are sufficient to demonstrate its innovation and interest.

The following description and figure represent an example of achievement of the invention, but they have no limiting character and, therefore, other achievements are possible within the framework of the range and extent of this invention, especially for other types of transducers.

BRIEF DESCRIPTION OF THE DRAWING

The unique figure is a cross sectional view of a particular type of transducer, equipped with the characteristic elements of the invention.

DETAILED DESCRIPTION OF PREFERRED EMBODIMENTS

As it is already known, the transducer represented in cross sectional view in this figure comprises two motors: two electro-acoustic motors 1, aligned along an axis xx', located on both sides of a central countermass 2, and coaxial inside a cylindrical shell 5 covering the motors 1, up to the end pavilion 3 of the latter. The cavity 7, delimited by the rear part of the pavilions and shell, communicates with the external immersion fluid 4 by means of openings 6 made in the shell 5.

The electro-acoustic motors 1 may be of the piezoelectric type, or they may comprise magnetostrictive cylinders surrounded by a trip coil.

Such electro-acoustic motors with a double motor are also called double Tonpilz.

In the figure, the electro-acoustic motors 1 and intermediate countermass 2 are represented as mounted and assembled, by various linking pieces 11, which are themselves linked to various fastening pieces 12, connecting the electro-acoustic motor or shell 5, by any fastening device, and enabling end pavilions 3 to freely move in relation to the shell, but determining a nearly closed internal cavity 7 between the respective edges 13 of the pavilions and shell.

The supply of the said electro-acoustic motors 1 is provided by any power cable 10, fastened on the linking pieces 11 by an electric connector 14.

The transducer and all the various constituting pieces are well known and can be carried out by anybody skilled in the art.

The principal characteristic of the process of the present invention and transducer according to this process, consists in comprising at least one flexible bladder 8, occupying at least part or all the volume of the cavity 7, and filled with a fluid 9 more compressible than the ambient fluid 4.

In fact, taking into account the presence of acoustic motors 1, various assembly pieces 11 and power cable 10, as well as the connections with shell 12, preferably the following may be provided:

either several independent bladders, which are inserted through openings 6 in the shell, after having been preferably filled;

or a single diaphragm occupying at least part or all the internal surface of the transducer cavity, and consisting of an elastomere skin for example, which is then filled with the fluid. However, in this case it is difficult to ensure filling without air bubbles remaining which would impair the efficiency of such a device, depending on the depth.

Indeed, fluid 9 occupying the volumes delimited by the skin of the bladders 8, must fill the cavity as much as possible and preferably in totality, since its volume shall be higher than that of the compliant tubes, such as those described in patent application FR 2 665 998 of May 5, 1988, in order to obtain characteristics of compressibility equivalent to that of the tubes used to date in this type of transducer. The frequency emission level drop within the range defined between both previously considered peaks, is in fact linked to the elasticity of this fluid volume contained in the cavity, and which has a role of that of the compliant tubes of the above mentioned patent.

That is why the fluid compressibility must be in fact lower than $10^9$ N/m$^2$, defined by the product of its volume mass $_f$ with the square of the sound propagation speed in this fluid $C_f$.

To obtain the value of the cavity global compliance, the following must be obtained at the same time:

* cavity 7 volume=fluid 9 volume+volume of the residual water which can exist in cavity 7
* system global compliance=(fluid volume/$_f \times C_f^2$ of the fluid)+(water volume/$2.22\times10^9$).

Simulation tests demonstrated that an equivalence of global compliance is obtained between ten 0.84-liter compliant tubes installed in a 45 liter cavity, and the same 45 liter cavity filled with 32 liters of fluid of the entirely fluored organic compound family of the C8H18 type.

Furthermore, in order to avoid any loss of efficiency at the level of the emitted acoustic efficient power, it is preferable to choose a fluid whose viscosity is not too high, even lower than that of water, preferably $6.5\times10^{-7}$ m$^2$/second, which is the silicone fluid viscosity and even with a product of the totally fluored organic compound family, such a C8H18, the kinematic viscosity is $4\times10^{-7}$ m$^2$/second. In addition this product is steady, even at very low temperatures, and at ambient temperatures.

To reinforce the above solution, and moreover to gain by the result already indicated in the fourth category of solutions previously mentioned in the introduction, the opening 6 is such that its dimensions are determined in order that by coupling shell 5 elasticity with the mass of the fluid located in this opening 6, the Helmholtz frequency of shell cavity 7 is close to the vibration fundamental frequency of all the transducer.

According to the example of the attached figure, a transducer according to the invention comprises two electro-acoustic motors 1 aligned on an axis xx' located on both sides of a central countermass 2 and coaxial inside the cylindrical hollow shell 5. The shell covers the motors 1 up to vibrating walls 3 forming the end pavilion of the latter. An opening 6 is provided in the shell near its median plane.

To improve the result of the device according to the invention and as indicated above, within the framework of the example of embodiment of the attached figure, each edge of the opening 6 is associated to a collar of material resisting to the pressure and integrated and solid with the shell (the collar is not represented in the figure).

We claim:

1. A process for making a transducer for emitting wide band and low frequency acoustic waves in unlimited immersion depths in an ambient medium, the transducer comprising at least one electro-acoustic motor connected to at least one vibration wall and a hollow shell having a cavity in which the at least one motor is positioned, said cavity being delimited by the at least one vibration wall, comprising the steps of:

providing at least one ambient medium opening in said shell that extends from said cavity;

providing, in at least part of the volume of the cavity, at least one flexible bladder; and filling the bladder with a liquid that is more compressible than the ambient medium.

2. A process for making a transducer for emitting wide band and low frequency acoustic waves in unlimited immersion depths in an ambient medium, the transducer comprising at least one electro-acoustic motor connected to at least one vibration wall and a hollow shell having a cavity in which the at least one motor is positioned, said cavity being delimited by the at least one vibration wall, comprising the steps of:

providing at least one bladder that is filled with a liquid that is more compressible than the ambient medium;

providing at least one opening in the shell for the passage of the filled bladder to the cavity; and introducing the bladder in the cavity through the opening so that at least part of the volume of the cavity is occupied by the at least one bladder.

3. A transducer for emitting wide band and low frequency acoustic waves in unlimited immersion depths in an ambient medium, comprising:

at least one electro-acoustic motor;

at least one vibration wall connected to the at least one motor;

a hollow shell in which the at least one motor is positioned, said shell having a cavity formed therein, said cavity having a wall portion comprising the at least one vibration wall, said shell having at least one ambient medium opening extending from the cavity; and at least one flexible bladder occupying at least part of the volume of the cavity, the bladder being filled with a liquid that is more compressible than the ambient medium.

4. The transducer for emitting acoustic waves according to claim 3, wherein the compressibility of the liquid is lower than $10^9$ N/m$^2$.

5. The transducer according to claim 3, wherein the maximum viscosity of the liquid is substantially equal to that of water.

6. The transducer according to claim 5, wherein the viscosity of the liquid is lower than $6.5\times10^{-7}$ m$^2$/second.

7. The transducer according to claim 3, wherein the liquid is a totally fluorinated organic compound of the $C_8F_{18}$ type.

8. The transducer according to claim 3, wherein the dimensions of the ambient medium opening are selected so that by coupling the shell elasticity to the ambient medium mass located in the opening, the Helmholtz frequency of the shell cavity is close to the fundamental frequency of the vibrations of the transducer.

9. The transducer according to claim 3, comprising two electro-acoustic motors aligned on an axis located on both sides of a central countermass, said motors being positioned coaxial to and inside the hollow shell, the at least one vibration wall forming an end pavilion of the shell, the opening being provided in the shell near a median plane of the shell.

10. The transducer according to claim 9, wherein the dimensions of the said opening are selected so that by coupling shell elasticity to the ambient medium mass located in the opening, the Helmholtz frequency of the shell cavity is close to the fundamental frequency of the vibrations of the transducer, the opening being peripheral and circular, the opening having at least one edge associated with a collar made of a pressure resistant material, the collar being integrated with the shell.

* * * * *